US008640271B2

(12) United States Patent
Cadavid

(10) Patent No.: US 8,640,271 B2
(45) Date of Patent: Feb. 4, 2014

(54) CARTRIDGE UNIT AND TRAP FOR SEWER GAS AND ODOR CONTAINMENT

(76) Inventor: Daniel Osorio Cadavid, Itagui (CO)

( * ) Notice: Subject to any disclaimer, the term of this patent is extended or adjusted under 35 U.S.C. 154(b) by 821 days.

(21) Appl. No.: 12/723,073

(22) Filed: Mar. 12, 2010

(65) Prior Publication Data

US 2011/0219528 A1 Sep. 15, 2011

(51) Int. Cl.

| | |
|---|---|
| ***E03D 13/00*** | (2006.01) |
| ***A47K 11/00*** | (2006.01) |
| ***F16K 13/00*** | (2006.01) |
| ***F16K 21/04*** | (2006.01) |

(52) U.S. Cl.
USPC ..... 4/301; 4/144.1; 137/247.15; 137/542; 137/543.17; 137/535

(58) Field of Classification Search
USPC ..... 4/301, 351, 306, 144.1, 311, 286–289; 137/247.15, 247.17, 536, 542
See application file for complete search history.

(56) References Cited

U.S. PATENT DOCUMENTS

| | | | | |
|---|---|---|---|---|
| 1,137,516 | A * | 4/1915 | Moon | 137/247.15 |
| 1,197,377 | A | 9/1916 | Kluin | |
| 1,208,675 | A | 12/1916 | Sleight | |
| 1,260,082 | A | 3/1918 | Sleight | |
| 2,942,617 | A | 6/1960 | Giliam | |
| 2,943,639 | A | 7/1960 | Smith | |
| 4,362,184 | A | 12/1982 | Marabeas | |
| 5,711,037 | A * | 1/1998 | Reichardt et al. | 4/301 |
| 6,318,973 | B1 | 11/2001 | Sailer et al. | |
| 6,701,541 | B2 | 3/2004 | Romagna et al. | |
| 7,114,515 | B2 | 10/2006 | Sponheimer | |
| D544,574 | S | 6/2007 | Cummings | |
| 7,636,957 | B2 * | 12/2009 | Funari | 4/301 |
| 2006/0278280 | A1 * | 12/2006 | Yang | 137/542 |
| 2007/0044848 | A1 | 3/2007 | Norman | |
| 2007/0074337 | A1 | 4/2007 | Funari | |
| 2007/0193633 | A1 * | 8/2007 | Howell et al. | 137/542 |
| 2008/0295233 | A1 * | 12/2008 | Fima | 4/144.1 |
| 2011/0203048 | A1 * | 8/2011 | Fima | 4/679 |

* cited by examiner

*Primary Examiner* — Gregory Huson
*Assistant Examiner* — Christine Skubinna
(74) *Attorney, Agent, or Firm* — Phillip Vales; Santucci Priore P.L.

(57) ABSTRACT

A cartridge unit for use with a urinal is disclosed that does not need water to work nor does it use a body of oily liquid sealant as an odor barrier. The odor trap cartridge unit used in this urinal has a spring locking mechanism that works as a valve. It is opened by liquid weight when the urinal is used and lets urine or any other liquid pass downwardly through it and prevents odors from flowing back up towards the room. The cartridge unit has a few disks, two main cylindrical devices, a spring, a fastener, an o-ring, and a coupling; these all operate to open and close a spring sealed trap. These are all placed within a unique three-sized shell that supports the entire cartridge and is fitted into a urinal opening. An umbrella shaped part completes the cartridge by protecting its components from violent fluid flow.

20 Claims, 9 Drawing Sheets

CARTRIDGE UNIT AND TRAP FOR SEWER GAS AND ODOR CONTAINMENT

CROSS REFERENCE TO RELATED APPLICATIONS

N/A

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the United States Patent and Trademark Office patent file or records, but otherwise reserves all copyrights whatsoever.

BACKGROUND (1) Field of the Invention

The present invention relates to improvements in odor containment for urinals and more particularly an odor barrier that does not require the use of any oily liquid.

(2) Description of the Related Art

Current Techniques

In our modern world, efficient and effective utilization of resources has become a hallmark of the environmental ethos. Conservation of fresh water, a primary natural resource, has finally arrived to the common household and to businesses. In the home and commercial applications, the activities of cleaning, drinking, showering, washing, and toilet usage are all ordinary uses of water individuals and businesses are determined to reduce water usage. To minimize the utilization of water in each of these activities would strike businessmen as being environmental friendly and would also represent a substantial financial savings. Thus, there is a desire to restrict the usage of water in these activities; in particular, there is a desire to limit the water used in urinals and toilets in every flush.

Next, sanitation codes require that urinals must provide an odor seal to contain sewer gases and other odors that develop in the ordinary functioning of the drainage system. Generally, P-traps and/or S-traps are utilized by drainage systems to form a seal in cooperation with the residual portion of the water used to flush the urinal. This kind of seal attempts to prevent sewer gases from exiting the drainage system up through the urinal. However, this type of seal does not effectively stop urine odor from flowing up through the urinal. In fact, the usage of these urinals requires multiple flushes each and every use in order to keep the trap free of residual urine and therefore the user's environment free of undesirable odors.

US PATENT CITATIONS

Several kinds of waterless or flush-less urinal systems have been developed trying to meet all of the above needs: a urinal that saves water or just does not use it and also provides a seal to contain sewer gases and odors. The most common example of these systems is the one described in the U.S. Pat. No. 5,711,037 to Reichardt and Gorges issued 27 Jan. 1998, entitled "Waterless urinal", which uses a body of oily liquid sealant as an odor barrier. The liquid seal includes urine to block sewer gases with an oil seal to block the urine odor from escaping into the restroom. This system has had several improvements (e.g., see U.S. Pat. No. 6,053,197 to Gorges) in its internal structure; the oil-sealed odor trap has had modifications that prolong sealant retention and that protects against high pressure water flushing. In spite of these changes, there remain various disadvantages with this kind of seal. For example, such systems require a strict maintenance regimen with monitoring by qualified personal that is not something one wants to spend money on. Additionally, the odor cartridges lifespan is not long enough to yield any appreciable cost savings.

Another type of waterless urinal system does not use an oil-sealed odor trap. This type utilizes an elastomeric membrane mechanism to provide odor prevention. The elastomeric membrane curls open to allow urine or water to pass through and then curls back up to prevent sewer gases from entering the restroom. This system is described in U.S Patent application publication No. 2006/0207005 to Janssen published 21 Sep. 2006, entitled "Cartridge apparatus for Urinal."

BRIEF SUMMARY OF THE INVENTION

A urinal cartridge odor control system comprises a urinal have an opening in a lower region for evacuation of fluids; a cartridge fitted to an opening located on the lower region of a urinal, such that the cartridge unit comprises an umbrella shaped part for deflection of materials, a locking section for opening and closing of the trap and a cylindrical shell for supporting the entire structure of the cartridge control system.

As stated above the system has a cylindrical shell; this shell has three different sizes ranging from largest to smallest and including a medium size, all of them coaxially linked by means of two tapered shapes where the largest size is on the top and the smallest size is on the bottom wherein the largest size's internal wall is in a watertight connection with a bottom region of the urinal. The cylindrical shell provides a support structure for the entire system as described further below.

A spring sealed trap housing fitted in the cylindrical shell's medium size's internal wall is made up of a coupling device fitted in the cylindrical shell's medium size's internal wall and resting on the second conical tapered shape that is closest to the bottom and a first cylindrical device having one or more passageways for permitting fluid to flow down arranged around a central column that extends upwards and the first cylindrical device inserted into the coupling device.

Further, a sealing disk is attached to the first cylindrical device using a spring locking mechanism. Also attached to the first cylindrical device is a seal attached to the top of the central column of the first cylindrical device so that the seal prevents fluids or gases to flow upwards through the first cylindrical device and blocks motion of a second cylindrical device. The spring locking mechanism further comprises a second cylindrical device inserted coaxially into the first cylindrical device such that the second cylindrical device has a flange at its top to respond to the motion of a spring arranged coaxially around the second cylindrical device and designed to compress and decompress against the second cylindrical device's flange and a ledge inside of the first cylindrical device.

To enable the attachment of the sealing disk with the second cylindrical device, the locking member is inserted coaxially underneath the sealing disk and passing through the sealing disk and passing through and threaded into the second cylindrical device so as to lock together the sealing disk and the second cylindrical device so as to engage the coaxially arranged spring. The system also includes an o-ring attached to the sealing disk so as to make a better seal between the sealing disk and the first cylindrical device and a weight disk to better balance the entire mechanism.

DETAILED DESCRIPTION OF THE INVENTION

Figure 1:
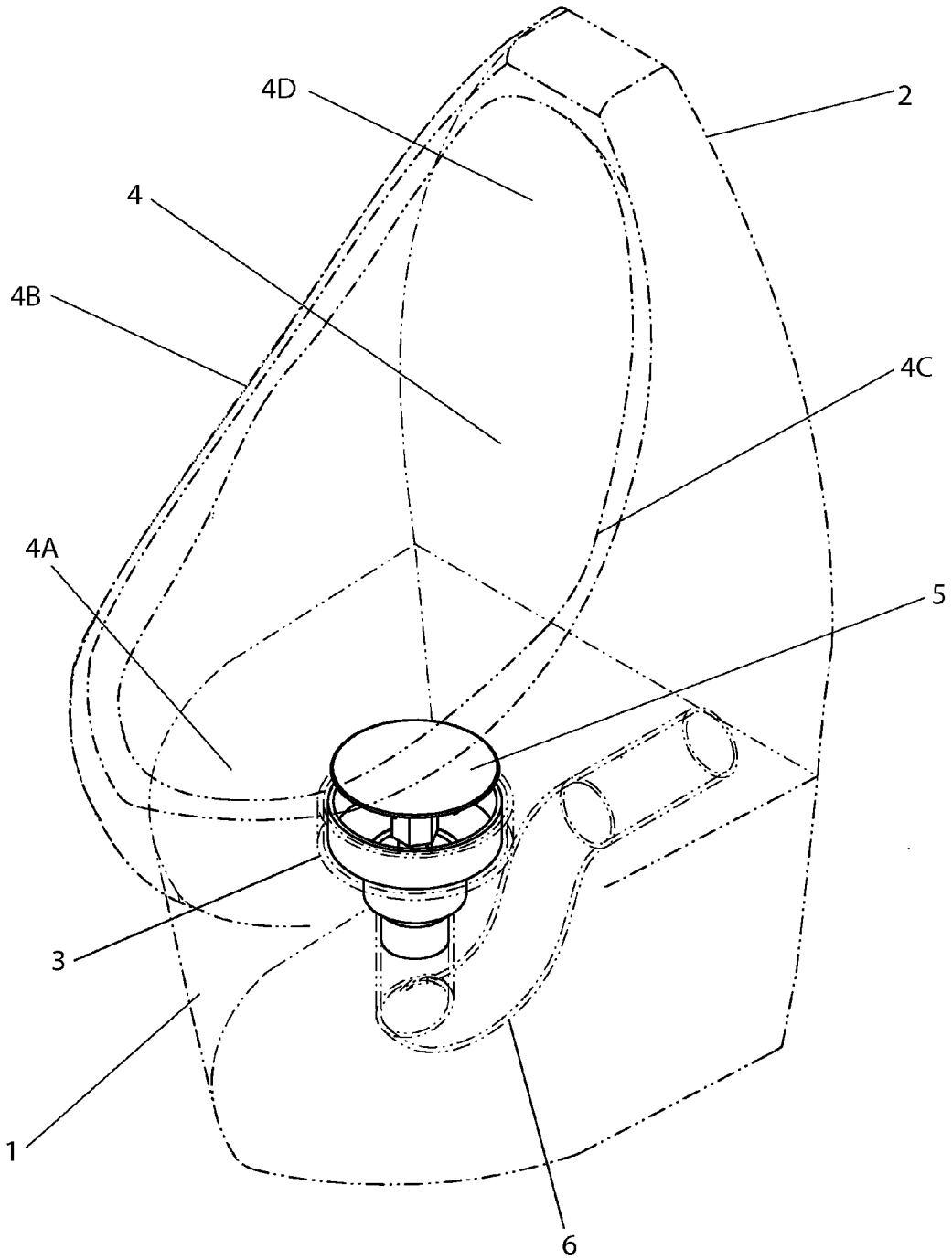
FIG. 1 illustrates the urinal assembly including a cartridge unit according to the present invention as well as a P-trap.

FIG. 1 shows a complete assembly 1, including a vitreous china urinal 2, a cartridge unit 5 according to the present invention and a P-trap 6. The illustrated urinal 2 being a wall mounted unit attached above a floor surface (not shown). The vitreous china urinal 2 includes a back wall region 4 and side-wall regions 4B, 4C which extend from a lower region 4A of the urinal 2 to an upper region 4D. The urinal 2 further includes a cylindrical opening 3 located on its lower region 4A with the cartridge unit 5 in a watertight connection with the lower region 4A, such that said cartridge unit 5 is configured to allow urine received on the urinal lower region 4A to be directed to a drain as shown in FIG. 2.

Figure 2:
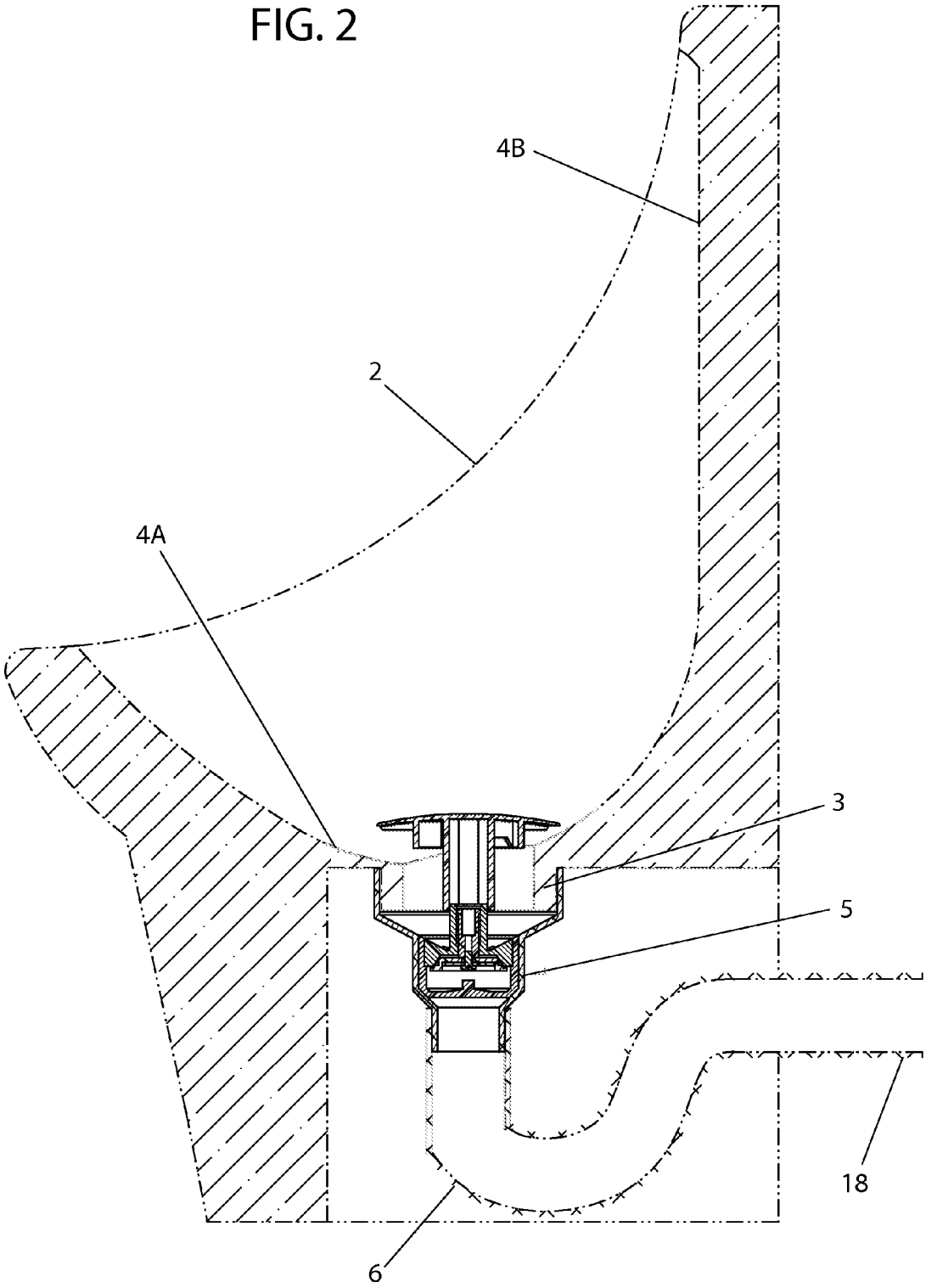
FIG. 2 illustrates a cross section of the urinal assembly shown in FIG. 1 and including a drain connection line.

FIG. 2 illustrates a cross section of the urinal assembly shown in FIG. 1 and includes a drain connection line 18. Here a P-trap 6 is connected to a drain connection line 18 for providing a pathway from the urinal lower region 4A to a sewer drain (not shown).

Figure 3:
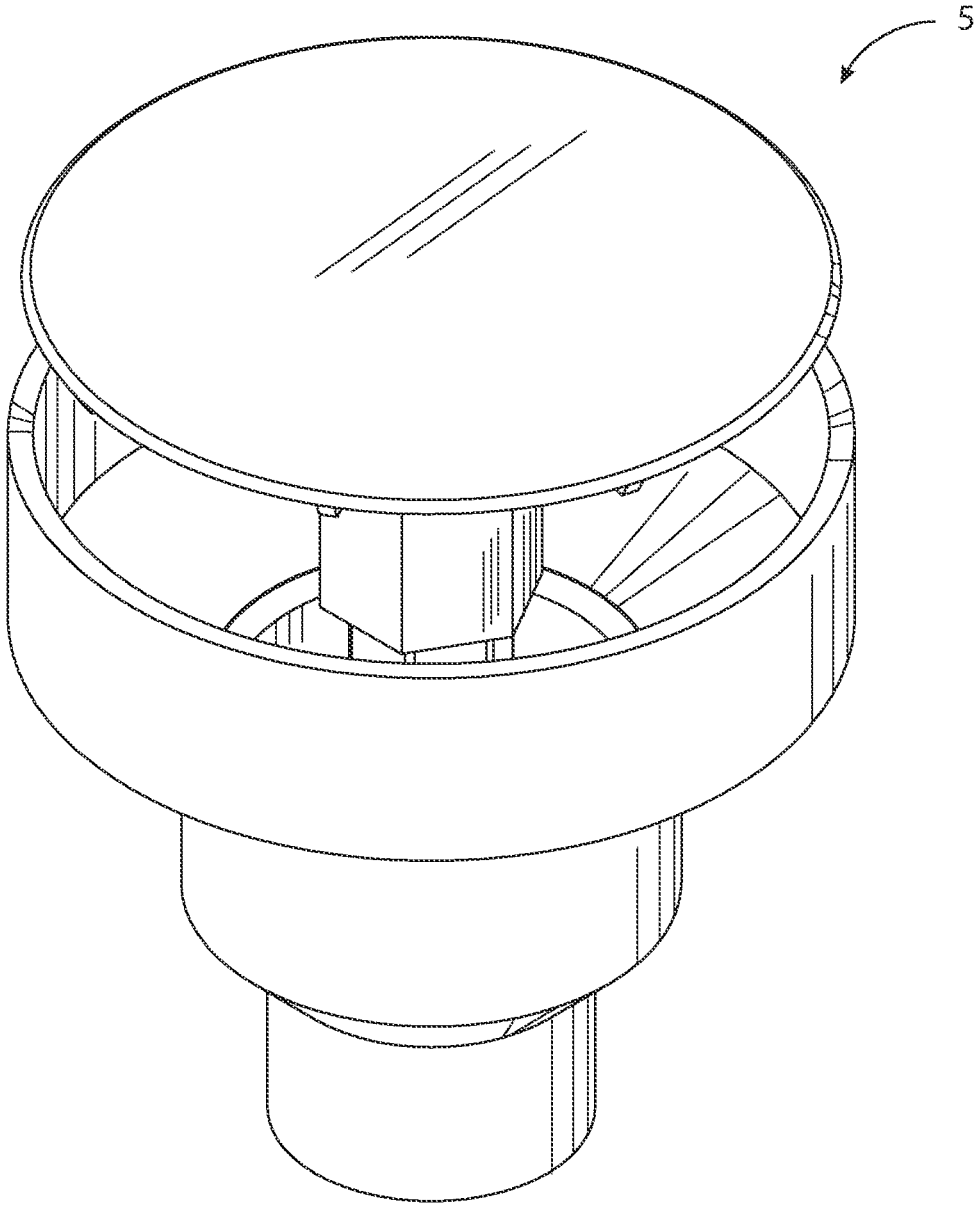
FIG. 3 illustrates the cartridge unit used in the urinal shown in FIGS. 1-2.

FIG. 3 illustrates the cartridge unit used in the urinal shown in FIGS. 1-2. The cartridge unit 5 is mainly composed of four parts that are typically molded from plastic such as ABS, polypropylene or PVC. These four parts are the tri-diameter conical tapered region external shell 16, the housing (coupling 15 and cylindrical member 8, 8A), umbrella 7 and the internal components 9, 9A, 10, 11, 12, 13, 14 and 21.

Figure 4:
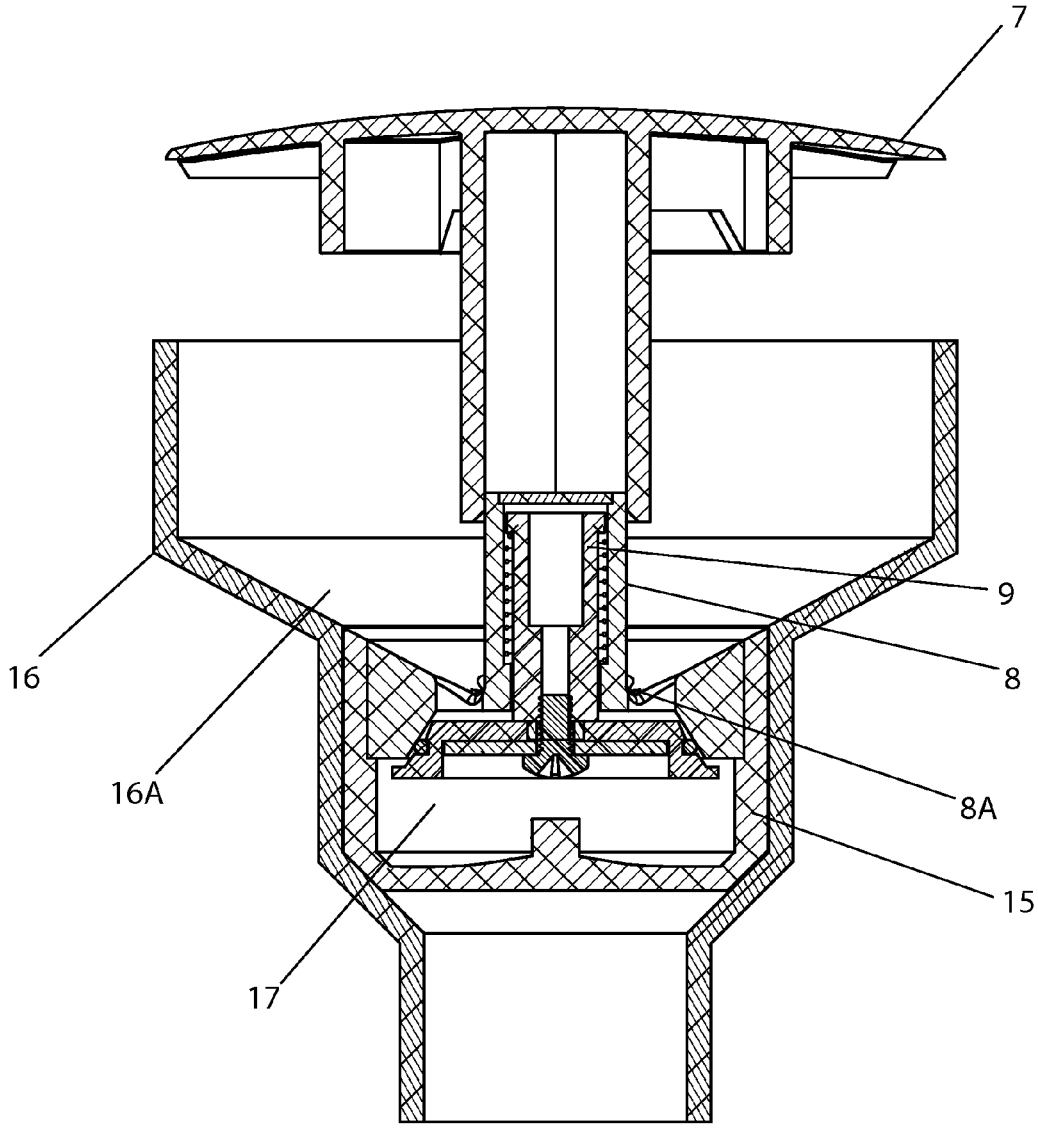
FIG. 4 illustrates a cross section of the cartridge unit shown in FIG. 3 and its internal components can be observed.

FIG. 4 illustrates a cross section of the cartridge unit shown in FIG. 3 with each of its several internal components shown in the drawing. When the urinal 2 is used, urine or any other liquid flows through the urinal back wall and side walls regions 4, 4B, 4C and is directed to the lower region 4A until it touches the cartridge unit 5 either on its top part 7 or on its external shell 16 (this top part 7 may be easily removed for maintenance activities such as cleaning routines or as trap replacements). The liquid flows first through the external shell's internal walls 16A and then through a cylindrical-shaped part 8 (8A holes) located below, which is inserted into a coupling 15 between it and the external shell 16. These 2 last parts (8 and 15) work as a housing for the spring-sealed trap 17. This trap can be observed in detail in FIG. 5 with its internal components. As will be obvious to those skilled in the art, the shell 16 can be seen being of one piece. Said another way, the shell 16 is depicted with a first portion, a second portion, and a third portion intrinsically joined and separated by two tapered sections. The first portion, i.e., the largest diameter, that has an internal wall sized to be in a watertight connection with the lower region of the urinal as shown in FIG. 2. As depicted in FIG. 3, the internal wall of the first portion of the cylindrical shell extends downwardly to a first inwardly tapered shape that coaxially loins the first portion of the cylindrical shell 16 to a second portion, i.e., a medium diameter, of the cylindrical shell 16. The second portion of the cylindrical shell 16 is smaller than the first portion of the cylindrical shell 16 and includes an internal wall extending downwardly to loin with a second inwardly tapered shape. The second inwardly tapered shape is sized to coaxially link the second portion of the cylindrical shell with a line of a fluid drainage system, as shown in FIG. 2 It can also be readily observed from FIG. 4 (as well as the exploded view in FIG. 5) that the coupling 15 is structurally unattached from the shell 16. Said another way, it can be placed in and removed from the shell 16 without manipulating the shell. As discussed below, the coupling 15 may be fitted within an internal wall of the shell 16 and prevented from moving, with respect to the shell 16.

Figure 5:
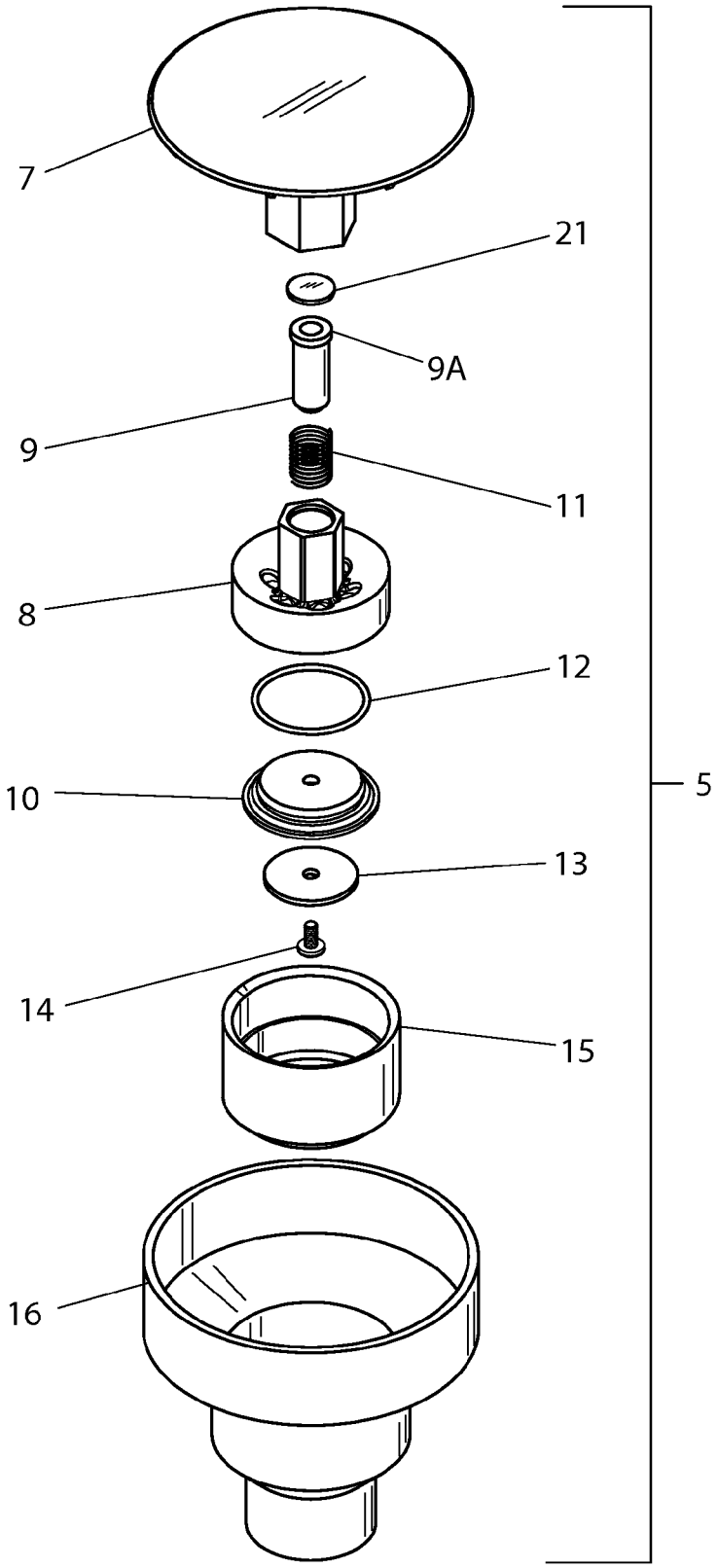
FIG. 5 illustrates an exploded view of the cartridge unit components.

FIG. 5 illustrates an exploded view of the cartridge unit components. Odor trap cartridge item 5 comprises the following components 7, 8, 8A, 9, 9A, 10, 11, 12, 13, 14, 15, 16 and 21. All of the components (7, 8, 9, 9A, 10, 11, 12, 13, 14, 15 and 21) are designed to fit into or associate themselves from the top of external shell 16. This is a cylindrical shell 16 having three different diameters that are coaxially linked by means of two conical tapered shapes where the larger diameter is on the top and the smaller diameter is on the bottom; of course the medium size diameter is located between the two of these and is linked to both of the other diameter's with the tapered sliced conical sections. The external shell's larger diameter's internal wall is connected in a watertight connection with the lower portion of the urinal (as shown in FIG. 2) and the medium diameter's internal wall is fitted with a spring-sealed trap housing. An umbrella shaped part 7 is designed to receive liquids that fall upon it and to divert fluids to the external shell's internal walls as previously discussed; it rides atop a cylindrically shaped part 8. This part and the umbrella are connected male to female with a hexagonal shaped column that is integral with item 8 and with the female hexagonal section of item 7. It should be noted that umbrella 7 has a hollow hexagonal column extending downwards whose internal female area forms a region for the reception of the hexagonal column extending upwards of cylindrical part 8.

Cylindrically shaped part 8 and coupling 15 forms a housing for the spring-sealed trap 17. The coupling 15 is fitted into the middle diameter of external shell 16 such that it will not be able to move during ordinary operation of the spring-sealed trap. The coupling 15 has an upper and a lower diameter; the upper diameter is for the fitting of cylindrically shaped part 8 such that motion of this part is prohibited whilst the bottom diameter is for the formation of a spring-sealed trap. Also, the coupling 15 has perforations or holes at its base to permit the flow of fluids and a central axially raised portion that is sized to block the 'overextended' motion of the downward movement of the valve operation so as to prevent it from disengaging. In other words, it prevents the motion from going to far. This raised portion corresponds to the movement of the locking screw 14 in the central axis as described previously. The bottom portion of cylindrically shaped part 8 fits snugly into the internal diameter of coupling 15 such that it does not move during normal operation. It rests upon a lip that extends out from the internal walls of coupling 15; thus, coupling 15 has within itself formed two internal diameters, one for the fitting of the cylindrically shaped part 8 and a smaller one for the formation of a trap 17.

Figure 6:
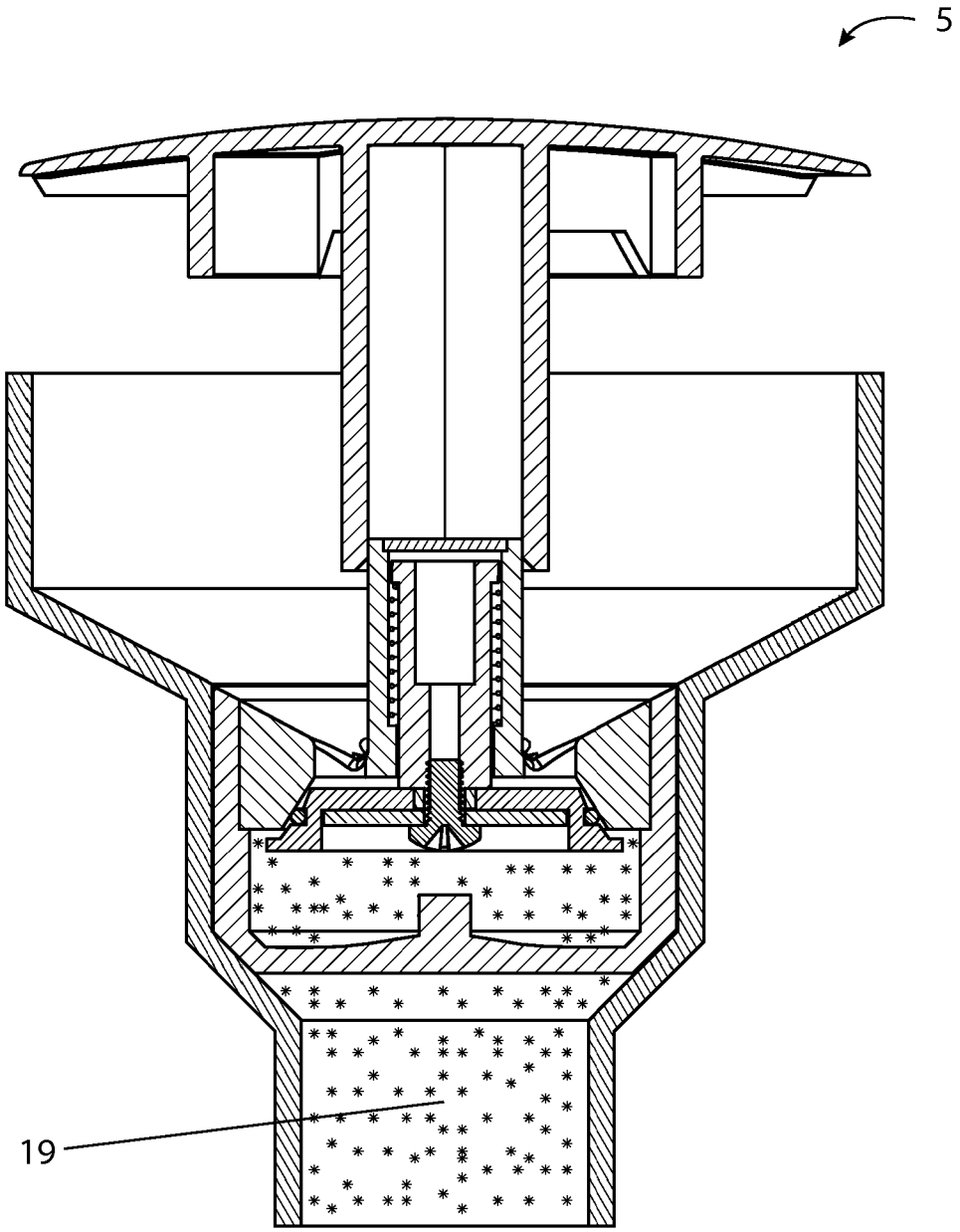
FIG. 6 illustrates the spring-sealed trap device in a closed state to prevent gases from exiting from the cartridge unit.
Figure 7:
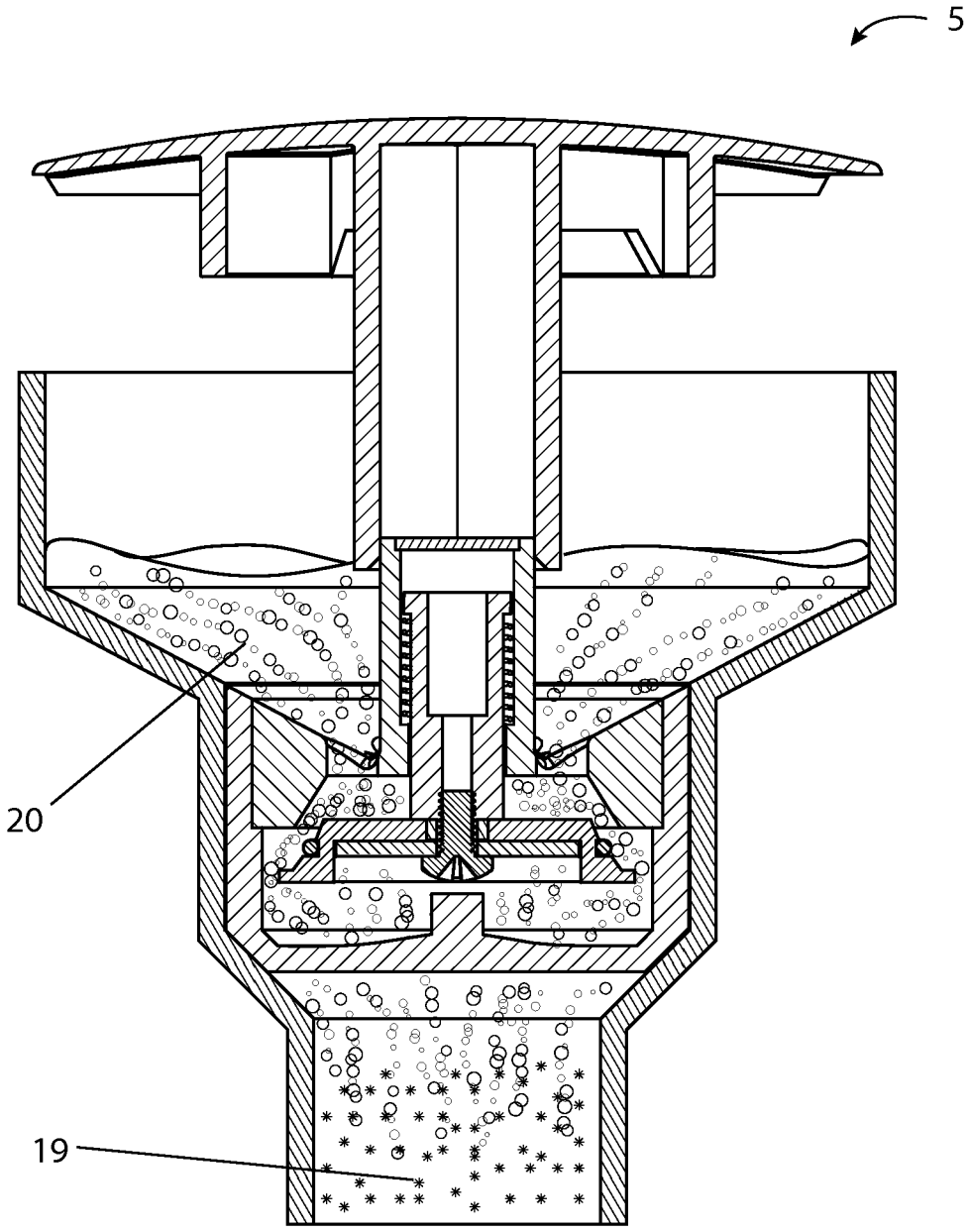
FIG. 7 illustrates the spring-sealed trap device in an open state to allow urine to pass through when this liquid or any other is present in the cartridge unit.

Once a liquid reaches the cylindrical-shaped part 8, it flows through several holes 8A located on this part's lower region and here is where the spring-sealed trap 17 acts as a valve: normally in a closed state (FIG. 6) to prevent gases 19 (e.g., including sewer gases and other urine odors) from exiting from the cartridge unit 5 and is in an open state (FIG. 7) to allow urine 20 to pass through this valve device when urine is received in the cartridge unit 5. As used herein, when gases 19 are prevent from exiting the cartridge unit 5, such gases may include sewer gases, urine odor, or any other gas or odor. The spring-sealed trap 17 is activated when a liquid (e.g., urine, water, liquid cleaners, etc.) falls over a flat disk 10 and its weight pushes the disk downwards as well as a cylinder 9 which is attached to it by one screw 14. This cylinder 9 is supported by a compression spring 11 by means of a circular flange 9A located on the upper part of the cylinder 9, this spring 11 is supported by the cylindrical-shaped part 8 therefore when the flat disk 10 and the cylinder 9 fall, the spring 11 is compressed and remains in this state (open state) until the weight on the flat disk 10 disappears and closes the trap (closed state). There are also two more parts which help the trap to properly work: an extra weight 13 which helps to open it when there is a weight on the disk 10 and a rubber o-ring 12 about disk 10 in a ridge or groove about the circumference of disk 10 that ensures a perfect seal when in a closed state.

The cylinder 9 that is integrated with a flange 9A along with spring 11 centrally wrapped around cylinder 9 operates within cylindrically shaped part 8 to open and close the disk 10 when liquids strike it. To complete the spring operation in the odor trap an upper seal 21 is required so that fluid and or gases will not flow back up the trap and through the cylindrically shaped part 8. This seal 21 is attached to the top of the hexagonal column that is integral with cylindrically shaped part 8 using physical pressure and a glue or adhesive. Thus, when the spring is fully extended the cylinder 9 cannot extend beyond the seal 21. When the spring is compressed because of weight being applied to the disk 10, flange 9A presses down against coaxially placed spring 11 that compresses within the cylindrically shaped part 8 and against a ledge formed within cylinder 8 that supports the other side of the spring 11. Thus, the spring 11 limits the motion of the disk 10 along with a centrally raised portion of coupling 15 prevents the device from disengaging.

Figure 8:
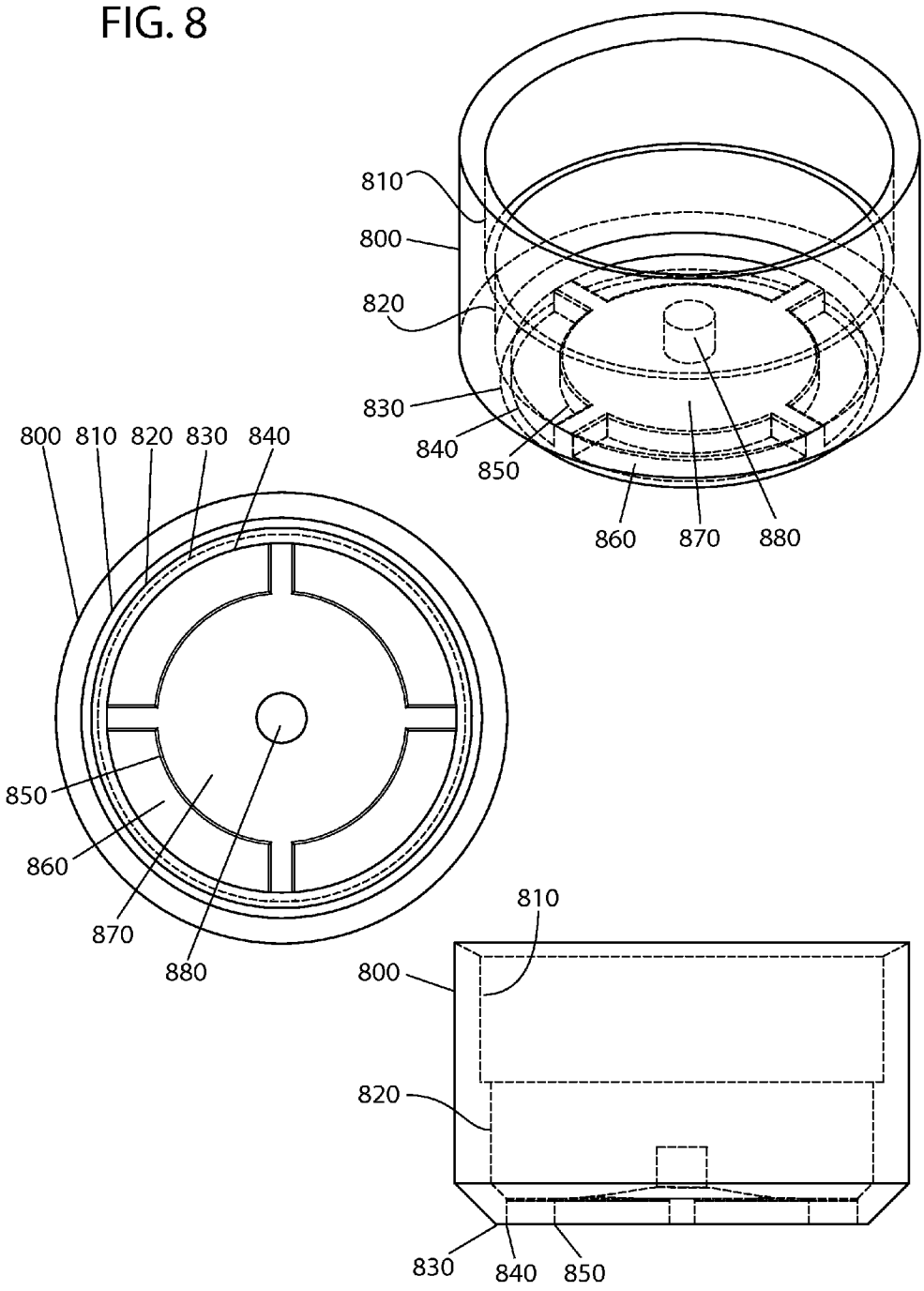
FIG. 8 illustrates the internal structure of coupling unit 15 as shown in several views of the coupling unit.

FIG. 8 illustrates the internal structure of coupling unit 15 as shown in several views of the coupling unit. The coupling 15 is generally a hollow cylinder that has various novelties that will be discussed in the following. Externally, it has a circular surface that begins with a circle 800 and ends at inner circles 810 and 820 forming a solid material for the cylinder. Thus, the cylinder has two internal circles of different diameters a larger one on top 810 and a smaller one 820 on the bottom forming two hollow circular spaces in the middle region of the coupling 15. The location of the change between the larger diameter 810 and smaller diameter 820 is the site of a ledge so as to fit cylindrical part 8 onto this ledge and form a trapping area underneath. The smaller diameter surface 820 tapers to an inner circular diameter 840 about the inner circumference of the coupling 15.

Returning to the external surface 800, it should be noted that upon approaching the bottom edge of coupling 15, the external surface 800 tapers to a material of circular shape 830. Thus, this forms a solid material edge about the bottom of the coupling 15 between circular material 830 and inner circular material 840 that meets it as the material forming circular surface 840 proceeds down to the plane formed by the bottom portion of the coupling 15 and then outwards to meet material circle line 830.

At the complete underside of coupling 15, a flow control region is shown formed of a circular material 870 and raised portion 880 surrounded by four supports in a cross-shaped pattern. The region between each of the cross-supports form cavities 860 that pass through the bottom of the coupling unit; these cavities 860 facilitate evacuation of materials and are in the shape of chords between inner circle material line 840 and the edge 850 of circular material 870 and the bottom of the coupling. The edge of the circular material 870 is shown at circle 850 that passes from the horizontal level of the tapered inner circumference 840 to the bottom surface of the coupling 15 forming a slab volume of material as shown. Additionally, the inner top portion of the circular region 870 is raised up until it reaches a central raised portion 880. This raised portion 880 prevents the spring trap from over extending itself.

Figure 9:
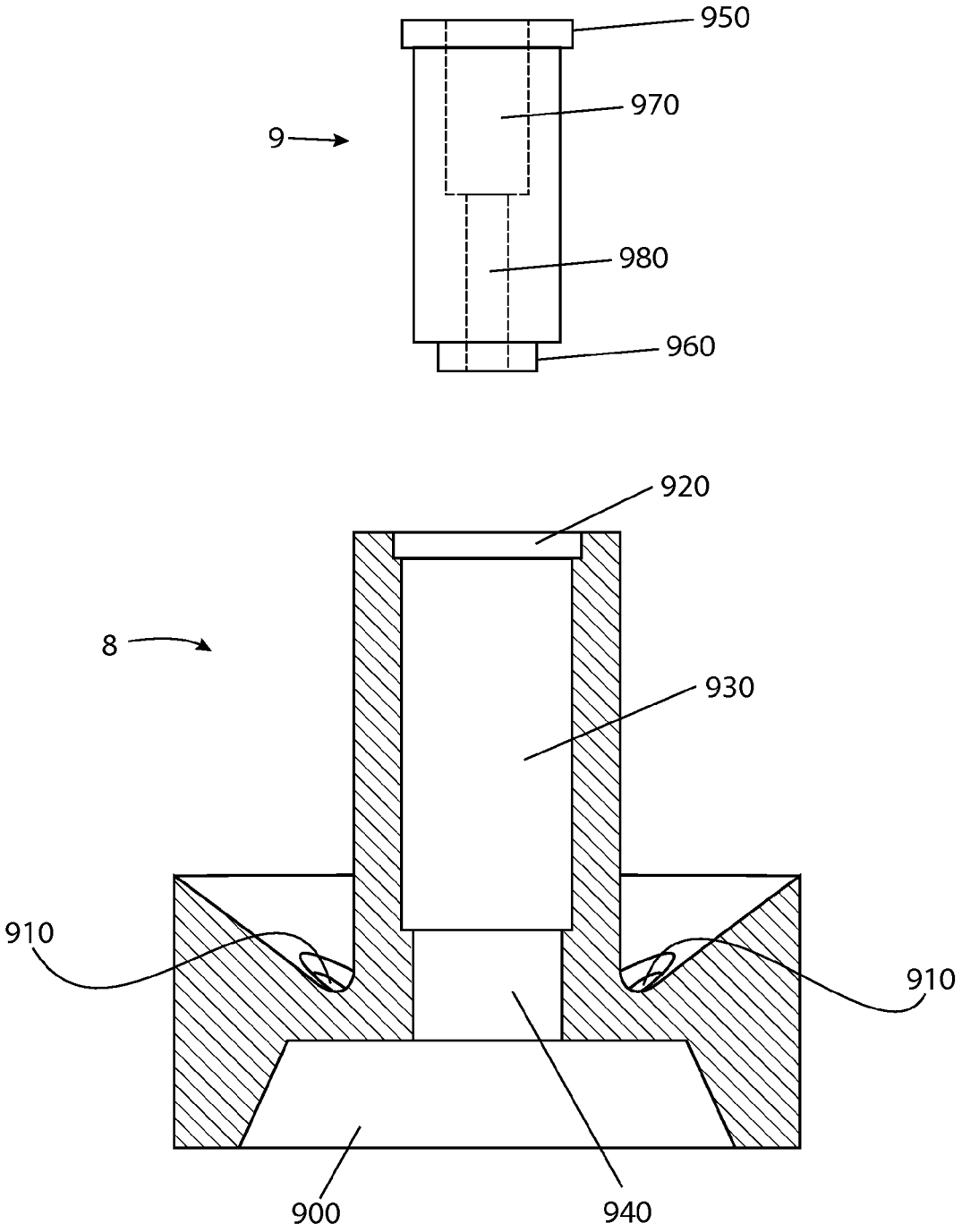
FIG. 9 illustrates the internal structure of cylindrically shaped part 8 and cylinder 9.

FIG. 9 illustrates the internal and external structure of cylindrically shaped part 8 and cylinder 9. It is this cylinder 9 (and 9A) that forms along with spring 11, cylindrically shaped part 8, seal 21, disks 10 and 13, ring 12 as well as fastener 14 a compressing decompressing opening and closing mechanism. The cylinder has two hollow areas in the shape of internal circular regions of a larger 970 and a smaller 980 circular portions. These two hollow regions extend from the top of cylinder 9 to its bottom whilst the second of these regions, the smaller hollow portion 980, is used as a threading for the insertion of screw fastener 14. The top and bottom of cylinder 9 forms a flange previously identified as 9A (flange) and a smaller cylindrical material 960. This smaller (in terms of diameter and vertical size) cylindrical material 960 is inserted into a central hollow circular region in disk 10 and there through until the edge of the underside plane of disk 10. Weighing disk 13 and screw fastener 14 are attached with the screw fastener 14 threaded through the central circular hole of weighing disk 13 passing through disk 10 and into the bottom threading 980 so that the head of the fastener will hold the assembly together.

Cylindrically shaped part 8 is shown in FIG. 9 in cross section showing in great detail its external and internal structure. A hollow trapezoidal area 900 in the figure actually represents a region that enlarges from one smaller circular region to another larger circular region forming a hollow circular volume there through. This volume holds the disks 10 and 13, fastener screw 14 and o-ring 12 as well as a bottom portion of cylinder 9 that is adjusted according to operational limits. Proceeding forward in the discussion of cylindrical part 8, it should be noted that there are two main solid cylindrical shapes associated with this part, namely, an upper portion and a lower portion. Both of these have been discussed previously, and in short review, the top portion is a hexagonal cylindrically shaped part with two inner hollow volumes 930 and 940 formed as extended circular volumes. The junction between hollow volumes 930 and 940 forms a spring circular working ledge because of the difference in diameters of the two. The top portion further extends down into the bottom portion such that the bottom portion's top edge is connected to the top portion's lower outer edge as a bowl shape to capture the flow of materials into holes 910 that pass through the cylindrically shaped part 8. The bottom portion of 8 is a material that has the hollow trapezoidal volume region 900 discussed previously and a section of the hollow volume 940 that extends from the top portion of this part.

At the extreme top of cylindrically shaped part 8 is a small rectangular area 920 as shown in FIG. 9. This is a vertically narrow and hollow volume formed by a uniform circular region that extends from the top of the part down the top portion of part 8 such that the diameter of this volume is larger than the corresponding lower diameters of hollow volumes 930 and 940. Sealing disk 21 is inserted into this small volume 920 with sufficient pressure and adhesive or glue so as to seal the top portion of this compression decompression mechanism. Cylinder 9 compresses and decompresses inside of hollow volume 930 using the flange 9A 950 and the spring 11 located under the same to compress and decompress against the ledge formed between the hollow regions 930 and 940 interface. It should be noted that the main external surface of cylinder 9, the medium sized material that lies between the largest material volume diameter 950 and smallest 960 of item 9, is designed to fit into hollow volume 940 so as to permit motion of cylinder 9 up and down as the materials hit disk 10.

Conclusion & Final Considerations

It should be appreciated that whilst the description has included certain specific shapes for the various parts this should not specifically limit the scope of applicant's disclosure. For example, the three diameter cylindrical shell is replaceable with different types of shapes such as three triangles, squares, pentagons, general polygons, ellipses, ovals, curves, combinations of the foregoing or other types of shapes that are adapted for usage in the teachings herein. Likewise the columns, cylinders, disks and other part herein are replaceable with mechanical items shaped in triangles, squares, pentagons, general polygons, ellipses, ovals or curves and they should be broadly interpreted as such.

The system described herein can bear high pressure water flushing without damaging or altering the essential parts for its normal operation. Additionally, the elimination of odors does not require the use of water; thus, it maximizes water utilization efficiency. Herein is disclosed a cartridge unit installed in a vitreous china urinal that isolates odors in a first closed state and permits urine flow to a drainage system in a second open state. This along with a P-trap is used to lock in sewer gases and other odors. The urinal includes one cylindrical opening in which the cartridge unit is coaxially installed so that the urine can flow easily to it using the internal urinal walls. The cartridge unit has several disks used to seal out odors in its closed state and upon receiving urine impacting the surface of a bottom disk the seal is opened so as to permit the flow of urine directly to a drain. Thus, the cartridge provides a sealed connection between the opening of the urinal and a drainpipe for allowing urine to be drained away.

The cartridge unit is composed of a top plastic part that has an umbrella shaped appearance and that functions to receives urine or any material, liquid or combination thereof and divert it in order to dissipate flow energy thus protecting the cartridge's internal parts. It should be noted that this part is the only one of the cartridge unit that is visible to a user and presents a pleasant appearance. Underneath it and coupled to this top part goes another plastic member which presents an internal tapered shape so that the liquid is directed to the center and flows downwardly through several holes which finish on a facing-down flat surface; its exterior face presents a cylindrical shape and goes firmly fastened to a third component located on the cartridge's bottom and acts as a lower limit to the above components. Within these two last components is housed a spring-sealed odor trap which is responsible for allowing urine and other materials or combinations thereof to be drained away through the holes when open and at the same time provides an odor seal when closed.

The spring-sealed odor trap comprises a cylinder attached to a disc and supported by a compression spring, which slides up and down due to the force exerted by the liquid's weight (downwards) and the spring's force (upwards). In other words, the spring's resultant force has to be lesser than the resultant force of the liquid's weight on the flat disc's upper face as well as it has to be enough large to get the disc and the cylinder back to its initial position when there is no liquid over the trap. The flat disc has a rubber o-ring facing the mechanism housing, so when it is in a closed state properly seals the upper part of the cartridge unit from the drain line, and it also has an extra weight attached by a screw to its underside in order to help it to open when there is a weight over it. The odor trap as well as its housing is housed in a plastic cylindrical-shaped shell which is underneath the urinal in a watertight connection. This shell helps the odor trap housing to direct the liquids from the urinal straight to the trap and it also conducts them out of the cartridge. Once the liquids are out of the cartridge unit they form a second trap (known as P-trap because of its shape) that acts to block sewer gases. Thus, the spring-sealed odor trap also provides both a sewer gas barrier and a urine odor barrier. Along with the P-trap, the cartridge unit ensures a reliable urinal operation and offers another option to those who are looking for a water-free urinal but without the problems of classical sealant methods.

The various parts in the cartridge unit are preferably composed of common plastics found in plumbing for urinals of this sort. The spring is preferably made up a metal or metallic alloy such as stainless steel. The O-ring is preferably composed of a rubber material or similar material. Various implementations are contemplated by inventor so as to facilitate diverse groups of material combinations of the many components of the invention. Thus, the parts described herein may be constructed to suit from combinations of materials such as plastic, cast iron, copper, ceramics, stainless steel, brass, glass, composites, stone, marbles, PVC and many more. Similarly, the urinal may be constructed of various types of common materials such as vitreous china, ceramics, metals, metallic alloys, enamels or combinations of the foregoing.

I claim:

1. A urinal cartridge odor control system comprising:

a urinal having an opening in a lower region for evacuation of fluids; and a cartridge fitted to an opening located on the lower region of a urinal, the cartridge comprising:

a one piece cylindrical shell unit having different sizes ranging from largest to smallest and including a medium size, all of them coaxially linked by two tapered shapes where the largest size is on the top and the smallest size is on the bottom wherein the largest size's internal wall accepts a structural portion of the lower region of the urinal to be in a watertight connection; and a trap housing including a coupling device, the coupling device structurally unattached from the one piece cylindrical shell and having a trap disposed therein.

2. The urinal cartridge odor control system of claim 1, wherein:

the trap housing is fitted in the cylindrical shell's medium size's internal wall.

3. The urinal cartridge odor control system of claim 2, wherein:

the coupling device fitted in the cylindrical shell's medium size's internal wall and resting on the second conical tapered shape that is closest to the bottom.

4. The urinal cartridge odor control system of claim 3, such that the trap housing further comprises:

a first cylindrical device having one or more passageways for permitting fluid to flow down arranged around a central column extending upwards and the first cylindrical device's external perimeter inserted into the coupling device.

5. The urinal cartridge odor control system of claim 4, such that the trap housing further comprises:

a sealing disk attached to the first cylindrical device using an attachment device.

6. The urinal cartridge odor control system of claim 5, such that the attachment device further comprises:

a spring locking mechanism.

7. The urinal cartridge odor control system of claim 6, such that the spring locking mechanism further comprises:

a second cylindrical device inserted coaxially into the first cylindrical device such that the second cylindrical device has a flange at its top to block the motion of a spring arranged coaxially around the second cylindrical device, the spring designed to compress and decompress against the second cylindrical device's flange and a ledge inside of the first cylindrical device.

8. The urinal cartridge odor control system of claim 7, such that the spring locking mechanism further comprises:

a locking member inserted coaxially underneath the sealing disk and passing through the sealing disk passing through the second cylindrical device so as to lock together the sealing disk and the second cylindrical device so as to engage the coaxially arranged spring.

9. The urinal cartridge odor control system of claim 8, further comprising:

a weighted disk attached to the bottom of the sealing disk by using a cavity in the weighted disk that permits passage of the same locking member as before so as to enable better performance of the system.

10. The urinal cartridge odor control system of claim 9, further comprising:

an o-ring arranged about the circumference of the sealing disk in a ridge of the top of the sealing disk adapted for use by the o-ring so that the o-ring will make a clean seal when the sealing disk is moved to its upper limit.

11. The urinal cartridge odor control system of claim 10 further comprising:

an umbrella-shaped part having a cylindrical portion extending from its underside that receives and makes a contact fitting with the upwards column of the first cylindrical device and configured to receive liquids that fall on it and to divert them to the external shell's internal walls; and a seal attached to the central column of the first cylindrical device so that the seal prevents fluids or gases to flow out through the first cylindrical device and adapted to block the motion of the second cylindrical device.

12. A urinal cartridge odor control system comprising:

a urinal have an opening in a lower region for evacuation of fluids; and a cartridge fitted to an opening located on the lower region of a urinal, the cartridge having:

a one piece cylindrical shell unit having different sizes ranging from largest to smallest and including a medium size, all of them coaxially linked by two tapered shapes where the largest size is on the top and the smallest size is on the bottom wherein the largest size's internal wall accepts a structural portion of the lower region of the urinal to be in a watertight connection; and a trap housing including:

a coupling device integrated with the cylindrical shell unit of the cartridge, the coupling device prevented from moving with respect to the cylindrical shell unit during ordinary operation a trap inserted within the coupling device; and a first cylindrical device having one or more passageways for permitting fluid to flow down said passageways where they are arranged around a central column extending upwards and the first cylindrical device is inserted into the coupling device.

13. The urinal cartridge odor control system of claim 12, such that the cartridge further comprises:

a cylindrical shell having different sizes ranging from largest to smallest and including a medium size, all of them coaxially linked by means of two tapered shapes where the largest size is on the top and the smallest size is on the bottom wherein the largest size's internal wall is in a watertight connection with the lower region of the urinal, wherein the trap housing is fitted in the cylindrical shell's medium size's internal wall.

14. The urinal cartridge odor control system of claim 12, such that the trap housing further comprises:

a sealing disk attached to the first cylindrical device using a spring locking mechanism.

15. The urinal cartridge odor control system of claim 14, such that the spring locking mechanism further comprises:

a second cylindrical device inserted coaxially into the first cylindrical device such that the second cylindrical device has a flange at its top to block the motion of a spring arranged coaxially around the second cylindrical device, the spring designed to compress and decompress against the second cylindrical device's flange and an internal ledge of the first cylindrical device.

16. The urinal cartridge odor control system of claim 15, such that the spring locking mechanism further comprises:

a locking member inserted coaxially underneath the sealing disk and passing through the sealing disk and passing through the second cylindrical device so as to lock together the sealing disk and the second cylindrical device so as to engage the coaxially arranged spring.

17. The urinal cartridge odor control system of claim 16, further comprising:

a weighted disk attached to the bottom of the sealing disk by using a cavity in the weighted disk that permits passage of the same locking member as before so as to enable better performance of the system.

18. The urinal cartridge odor control system of claim 17, further comprising:

an o-ring arranged about the circumference of the sealing disk in a ridge of the top of the sealing disk adapted for use by the o-ring so that the o-ring will make a clean seal when the sealing disk is moved to its upper limit.

19. The urinal cartridge odor control system of claim 18, further comprising:

an umbrella-shaped part having a cylindrical portion extending from its underside that receives and makes a contact fitting with the upwards column of the first cylindrical device and configured to receive liquids that fall on it and to divert them to the external shell's internal walls; and a seal attached to the central column of the first cylindrical device so that the seal prevents fluids or gases to flow out through the first cylindrical device and adapted to block the motion of the second cylindrical device.

20. A urinal cartridge odor control system comprising:

a cartridge sized to fit a lower region of a urinal defining an opening for the evacuation of fluids, the cartridge comprising:

a cylindrical shell unit having a first portion including an internal wall sized to accept a structural portion of the lower region of the urinal to be in a watertight connection, the internal wall of the first portion of the cylindrical shell extending downwardly to a first inwardly tapered shape that coaxially joins the first portion of the cylindrical shell to a second portion of the cylindrical shell, the second portion of the cylindrical shell unit being smaller than the first portion of the cylindrical shell unit and including an internal wall extending downwardly to join with a second inwardly tapered shape, the second inwardly tapered shape sized to coaxially link the second portion of the cylindrical shell with a line of a fluid drainage system; and a trap housing having a coupling, the coupling structurally unattached from the cylindrical shell and including a trap disposed therein, wherein the trap has a closed position and an open position, the open position operable to place the line of the fluid drainage system in fluid communication with the opening of the urinal.

* * * * *